US005611700A

United States Patent [19]

Mitra

[11] Patent Number: 5,611,700

[45] Date of Patent: Mar. 18, 1997

[54] CONNECTOR HAVING PLATE-TYPE INTERNAL SHIELDING

[75] Inventor: Niranjan K. Mitra, Eindhoven, Netherlands

[73] Assignee: Berg Technology, Inc., Reno, Nev.

[21] Appl. No.: 256,753

[22] PCT Filed: Jan. 22, 1993

[86] PCT No.: PCT/NL93/00022

§ 371 Date: Sep. 6, 1994

§ 102(e) Date: Sep. 6, 1994

[87] PCT Pub. No.: WO93/15533

PCT Pub. Date: Aug. 5, 1993

[51] Int. Cl.[6] ..... H01R 13/652

[52] U.S. Cl. ..... 439/101; 439/608

[58] Field of Search ..... 439/101, 108, 439/608

[56] References Cited

U.S. PATENT DOCUMENTS

| | | | |
|---|---|---|---|
| 3,660,803 | 5/1972 | Cooney | 439/637 |
| 4,655,518 | 4/1987 | Johnson et al. | 439/101 |
| 5,004,427 | 4/1991 | Lindeman | 439/101 |
| 5,169,324 | 12/1992 | Lemke et al. | 439/101 |

FOREIGN PATENT DOCUMENTS

| | | |
|---|---|---|
| 0455367 | 4/1991 | European Pat. Off. . |
| 8713091 | 12/1987 | Germany . |
| WO8804484 | 6/1988 | WIPO . |

*Primary Examiner*—Gary F. Paumen

*Attorney, Agent, or Firm*—Woodcock Washburn Kurtz Mackiewicz & Norris

[57] ABSTRACT

The invention relates to an electrical connector assembly comprising a plug connector and a socket connector mating therewith, which plug connector is provided with at least two rows of terminal connections and which socket connector is provided with at least two rows of terminal connections. The plug connector is provided with at least one electrically conducting first type of shielding member arranged between the rows of terminal connections, and the socket connector is provided with at least one conducting second type of shielding member arranged between the rows of terminal connections. The first shielding member and the second shielding member make electrically conducting contact with one another when the plug connector and the socket connector have been pushed into one another, wherein the first type of shielding member in the plug connector and the second type of shielding member in the socket connector slide along each other in one plane to make electrical contact.

18 Claims, 8 Drawing Sheets

CONNECTOR HAVING PLATE-TYPE INTERNAL SHIELDING

BACKGROUND OF THE INVENTION

The invention relates to an electrical connector assembly comprising a plug connector and a socket connector mating therewith, which plug connector and socket connector can be pushed into one another, which plug connector is provided with at least two rows of terminal connections which are accommodated in a first plastic housing and at least one row of which consists of male terminal pins, and which socket connector is provided with at least two rows of terminal connections which are accommodated in a second plastic housing and at least one row of which consists of female terminal connections, one male terminal pin always being in electrically conducting contact with a female terminal connection when plug connector and socket connector are pushed into one another, the plug connector being provided with at least one electrically conducting first type of shielding member arranged between the rows of terminal connections in the plug connector and being rigidly accommodated in the first housing, the socket connector being provided with at least one conducting second type of shielding member arranged between the rows of terminal connections in the socket connector, being rigidly accommodated in the second housing and comprising at least one first type of sprung contact element, which first shielding member and second shielding member make electrically conducting contact with one another when the plug connector and the socket connector have been pushed into one another.

Such a connector assembly is disclosed by the International Patent Application WO 88.04484. This describes two connectors, a plug connector and a socket connector which can be pushed into one another. The plug connector comprises two rows of male terminal pins which are able to mate with two rows of female terminal connections of the socket connector. Between the two rows of male terminal pins in the housing of the plug connector there is accommodated at least one plate-type shielding member. Accommodated between the two rows of female terminal connections in the housing of the socket connector is also a shielding member which has a female structure with sprung lips which grip round the plate-type shielding member of the plug connector if the plug connector is connected to the socket connector. If a plug connector and a socket connector are connected, shielding against electromagnetic interference is therefore produced between the two rows of male and female terminals. The shielding members may optionally be used for power supply or may be set to a predetermined voltage, for example ground. A variety of such, electrically separated combinations of a shielding plate and a female shielding member may be provided alongside one another, which combinations can each supply their own voltage or current.

A disadvantage of the known device is that the shielding plate in the plug connector is not sprung and is relatively thick. As a result, the combination of a shielding consisting of a shielding plate which is accommodated in a gripping manner in a female shielding member of a socket connector takes up a relatively large amount of space. This obstructs further miniaturized.

SUMMARY OF THE INVENTION

The object of the invention is to construct the entire shielding, consisting of the combination of a shielding member in both the plug connector and the socket connector in such a way that it can be miniaturized further.

For this purpose, a connector assembly according to the invention has the characteristic that the first type of shielding member in the plug connector contains at least one second type, also sprung, of contact element which is situated at least virtually in one plane and that each first type of sprung contact member in the socket connector is situated at least virtually in one plane.

As a result of these measures, the shielding combination no longer needs two different types of shielding member, namely, one having a stiff male part and one female part provided with lips situated opposite one another. The shielding members both in the plug connector and in the socket connector can be made of very thin, simply constructed, conducting plate material and the space required for the entire shielding is substantially less than in the known device.

In a first embodiment, the connector assembly according to the invention has the characteristic that the first type of shielding member is provided with a first elongated support for the sprung contact elements, wherein each of the contact elements is connected to the support via a narrow neck providing the spring action.

In another embodiment, the connector assembly according to the invention has the characteristic that the second type of shielding member is provided with a second elongated support for the sprung contact elements, wherein each of the contact elements is connected to the support via a narrow neck providing the spring action.

In yet another embodiment, the connector assembly according to the invention has the characteristic that the first type of shielding member comprises several contact elements which are arranged alongside one another and consist of alternately closed contact elements and open contact elements, the latter being provided with at least two lips.

In yet another embodiment, the connector assembly according to the invention has the characteristic that the second type of shielding member comprises several contact elements which are arranged alongside one another and consist of alternately closed contact elements and open contact elements, the latter being provided with at least two lips.

In yet another embodiment, the connector assembly according to the invention has the characteristic that, when plug connector and socket connector are pushed into one another, closed contact elements are always situated opposite open contact elements.

In yet another embodiment, the connector assembly according to the invention has the characteristic that the first shielding member comprises several closed contact elements situated alongside one another.

In yet another embodiment, the connector assembly according to the invention has the characteristic that the second shielding member comprises several closed contact elements situated alongside one another.

In yet another embodiment, the connector assembly according to the invention has the characteristic that the first shielding member comprises several closed contact elements situated alongside one another and the second shielding member comprises several open contact elements situated alongside one another, and when plug connector and socket connector are pushed into one another, the closed contact elements are situated opposite an open contact element.

In yet another embodiment, the connector assembly according to the invention has the characteristic that the second shielding member comprises several closed contact elements situated alongside one another and the first shielding member comprises several open contact elements situated alongside one another, and, when plug connector and socket connector are pushed into one another, the closed contact elements are situated opposite an open contact element.

In yet another embodiment, the connector assembly according to the invention has the characteristic that the second shielding member comprises several closed contact elements situated alongside one another and the first shielding member comprises several closed contact elements situated alongside one another, and when plug connector and socket connector are pushed into one another, the closed contact elements of the second shielding member close off the opening between two adjacent, oppositely situated closed contact elements of the first shielding member and the closed contact elements of the second shielding member close off the opening between two adjacent, oppositely situated closed contact elements of the first shielding member.

In yet another embodiment, the connector assembly according to the invention has the characteristic that the ends of adjacent contact elements of both the first and the second type of shielding member are to some extent bent, turn and turn about, to an oppositely facing side. This embodiment has the advantage that the internal stresses in the two shielding members which occur when a plug connector is connected to a socket connector are compensated for.

In yet another embodiment, the connector assembly according to the invention has the characteristic that the first shielding member is made of conducting plate material approximately 0.15 mm thick.

In yet another embodiment, the connector assembly according to the invention has the characteristic that the second shielding element is made of conducting plate material approximately 0.15 mm thick.

BRIEF DESCRIPTION OF THE DRAWINGS

The invention will be explained below by reference to a drawing which is solely intended to illustrate and must not be interpreted in a limiting sense. In the drawings.

DETAILED DESCRIPTION OF THE EMBODIMENTS

Figure 1A:
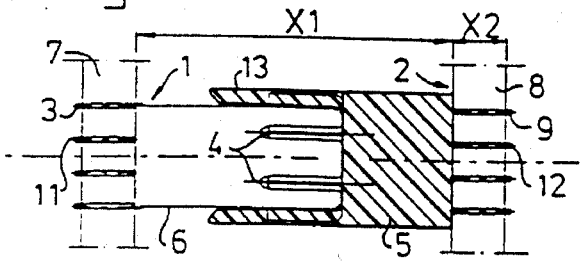
FIG. 1*a*, b and c show a plug connector and a socket connector pushed into one another, without shielding plate.

In the Figures, the same reference numerals always refer to the same components. FIGS. 1*a, b* and *c* show a connector 1 provided with female terminal connections 10; this connector is referred to below as "socket connector". The female terminal connections 10 clamp round male terminal pins 4 of the connector 2 which mates therewith and which will be referred to below as "plug connector". In this connection, it is pointed out that, in the figures attached hereto, the plug connector 1 is always provided with two parallel rows of male terminal pins 4, but that it is always possible to replace one row thereof by a row of female terminal connections 10. The same applies, but in that case conversely, to the rows of female terminal connections in the socket connector 1. It is possible, furthermore, to accommodate more than two rows of terminal connections in both the plug connector and the socket connector, with a shielding member between all the rows or between some of the rows.

Figure 1B:
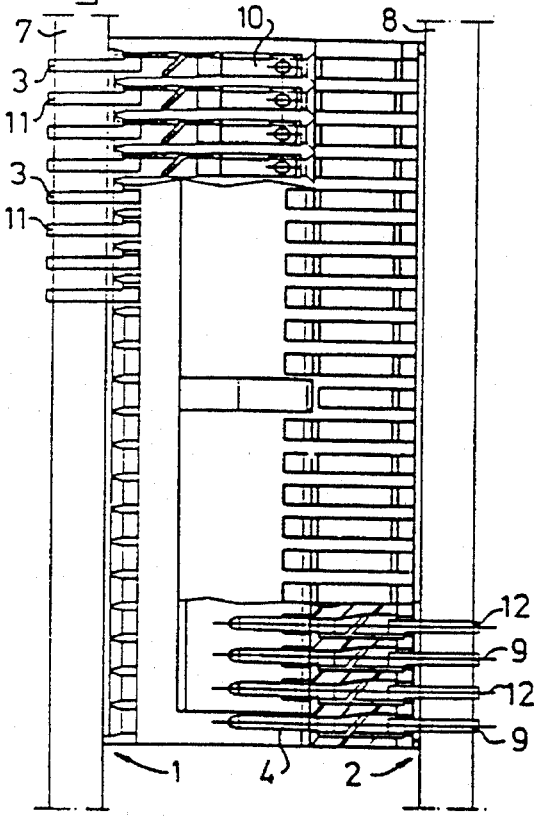
Figure 1C:
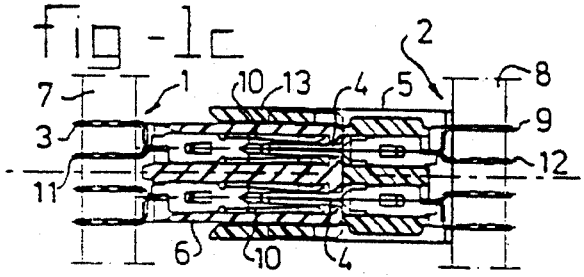

Every female terminal connection 10 leads, via feed-through 3 (or 11) to a printed circuit board 7 for electrical connection to other circuit elements (not shown). Every female terminal connection 10 has one feed-through 3 or 11: if, viewed in the longitudinal direction (FIG. 1*b*), a particular terminal connection 10 has a feed-through 3, then the adjacent terminal connection 10 has a feed-through 11 which, viewed in cross section, is closer to the centre of the connector (FIG. 1*c*) than the feed-through 3. The female terminal connections 10 are rigidly accommodated in a plastic housing 6. The end consists of two sprung lips which are able to clamp rigidly around a male terminal pin 4 of a plug connector 2 in order, in this way, to make a rigid electrically conducting contact. In the width of the socket connector 2 there is room for two parallel rows of female terminal connections 10 (FIG. 1*c*).

Every male terminal pin 4 is led further via a feed-through 9, 12 to a printed circuit board 8 for electrical connection to other circuit elements (not shown). The male terminal pins 4 are rigidly accommodated in a plastic housing 5. The plastic housing 5 of the plug connector 2 comprises two walls 13 which grip round the housing 6 of the socket connector 1. Just like the feed-throughs 3 and 11 of the socket connector, the feed-throughs 9 and 12 are alternately fitted closer to, and further away from, the centre line in the cross section of the plug connector 1. In the width of the plug connector 1, there is always sufficient room for two adjacently situated rows of male terminal pins 4 (FIG. 2*c*).

If the connectors 1 and 2 are rigidly pushed onto one another, the spacing ×1 between the printed circuit board 7 and the printed circuit board 8 is preferably 9.6 mm. The thickness ×2 of the printed circuit board 7 or 8 is, for example, 1.6 mm.

Figure 2A:
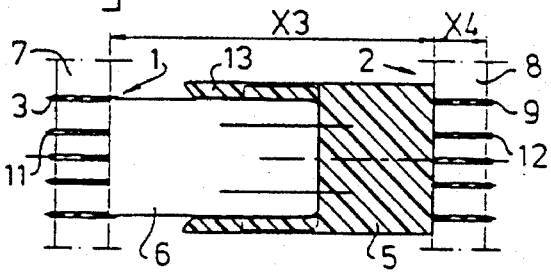
FIGS. 2*a*, b and c show a plug connector and a socket connector pushed into one another, with shielding plate.

FIGS. 2*a, b* and *c* show socket connector 1 and plug connector 2 which grip into one another and which are both provided, according to the invention, with a shielding plate 14 and 15, respectively. If the socket connector 1 and the plug connector 2 are rigidly pushed against one another, the shielding plates 14 and 15, respectively, make electrically conducting contact and in this way form an electromagnetic shielding against crosstalk between one row of connections (for example the uppermost row in FIG. 2*c*) and the other row of connections (the lowermost row in FIG. 2*c*). The shielding plate 14 leads via a feed-through 16 through the printed circuit board 7, while the shielding plate 15 is lead via a feedthrough 17 through printed circuit board 8. Via the feed-through 16 or 17 the shielding plate 14 or 15, respectively, can be set to a predetermined voltage, for example ground potential. The shielding plate can also be set, for example, to the supply voltage.

The spacing ×3 between the printed circuit boards 7 and 8 is equal to the spacing ×1 in FIG. 1*a* and is therefore, preferably, 9.6 mm. The thickness ×4 of the printed circuit boards 7 and 8 is equal to ×2 in FIG. 1*a* and is therefore also, for example, 1.6 mm.

Figure 2B:
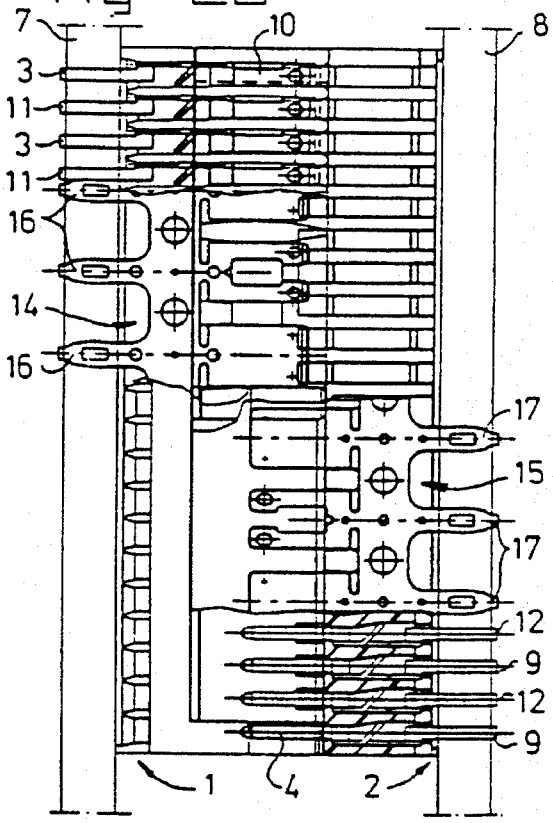
Figure 2C:
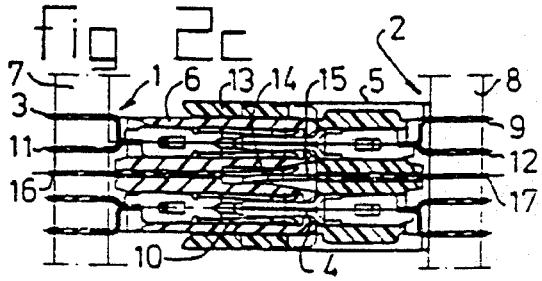
Figure 3:
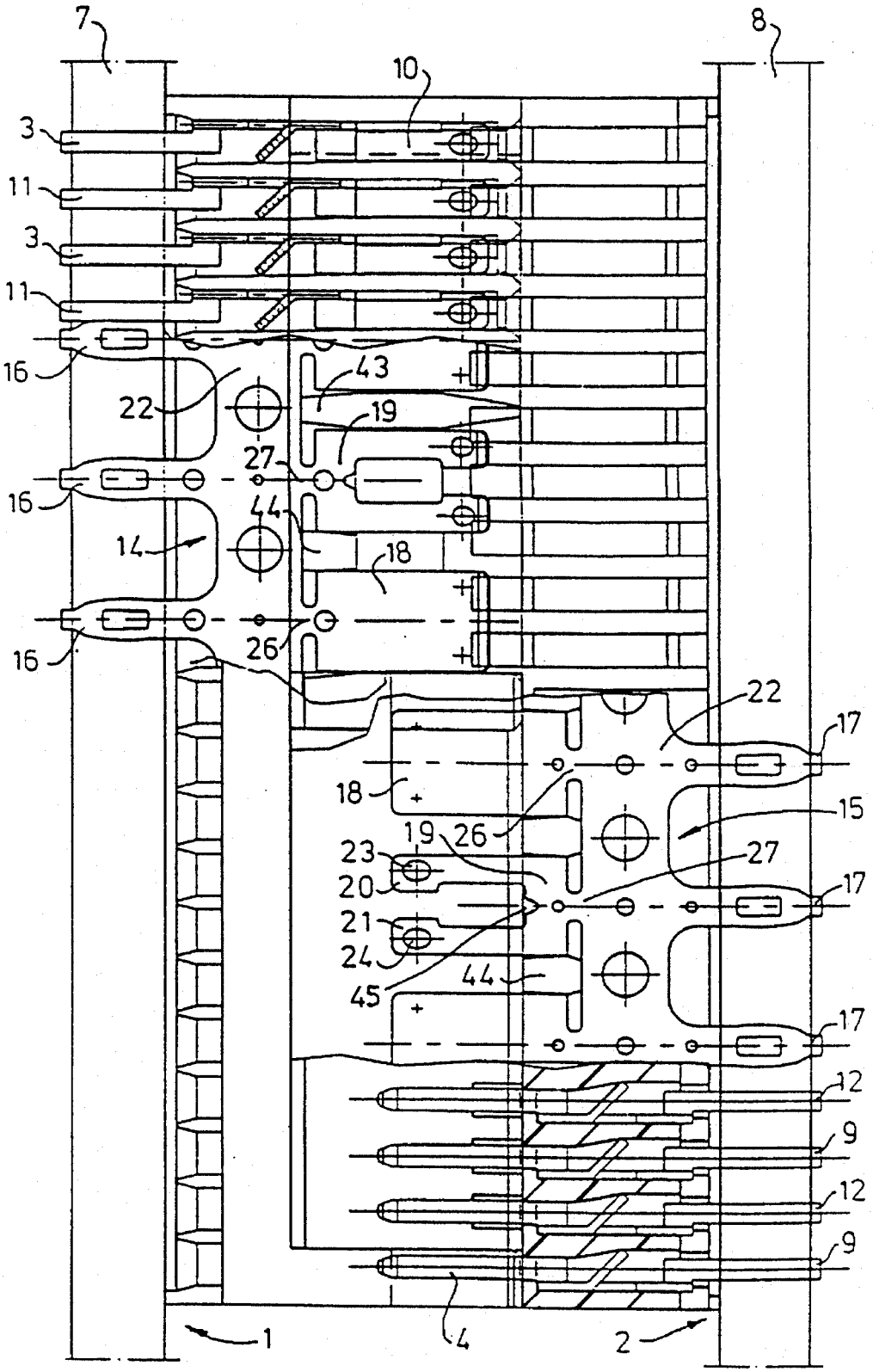
FIG. 3 shows an enlarged view of FIG. 2*b;*

FIG. 3 shows FIG. 2*b* enlarged. Here the construction of a preferred embodiment of the shielding plate 14, 15 can be seen. The shielding plate 15 comprises an elongated support 22. On one side of the support 22 there extend alternately different contact elements 18 and 19 which are connected by a thin neck 26, 27 to the support 22. The necks 26, 27 are so thin that the contact elements 18 and 19 are able to spring with respect to the support 22 in a direction perpendicular to the plane of the drawings of FIG. 3. The contact element 18 is completely closed, whereas the contact element 19 is provided with two lips 20, 21 which form an opening in between. Provided on the ends of the lips 20, 21 are dimples 23, 24. These dimples 23, 24 are provided in order to ensure a high mechanical contact stress in the event of contact with a closed contact element 18, situated opposite the open contact element 19, of a plug counter connector 1 mating with the plug connector 2. This will be explained in still greater detail by reference to FIG. 4. At the other side of the support 22 are the feed-throughs 17 which lead to the printed circuit board 8.

The contact elements 18, 19 are, as stated, constructed in such a way that they can spring perpendicularly to the plane of the drawing of FIG. 3. In order to prevent the contact elements 18, 19 from tilting sideways in the plane of the drawing around the necks 26, 27, small projections 44, against which the contact elements rest, are accommodated between adjacent contact elements 18, 19 in the wall of the housing. In the socket connector 1, in place of the small projections 44 between some adjacent and contact elements 18, 19, elongated projections 43, which fulfil the same function as the small projections 44 mentioned above can be accommodated in the wall of the housing. Both the small projections 44 and the projections 43 also have a second function; they also rest against the support 22 of the shielding plate 14 and thereby prevent the shielding plate from being able to move within the housing when the feed-throughs 16 of the shielding plate are pushed into openings, intended therefore, in the printed circuit board 7. The projections 43 project outwards to such an extent inside the socket connector 1 that they rest precisely against a small projection 44 between two adjacent contact elements 18, 19 of a plug connector 2 when the socket connector 1 is connected to the plug connector 2. With the same object, the plug connector 2 may also contain some elongated projection 43 of this type. These latter are not shown in the Figure but are not, of course, situated opposite the projections 43 in the housing of the socket connector 1.

All the open contact elements 19 may be provided with a notch 45 in the portion connecting the two lips 20, 21 to one another. Notch 45 mates with a rib in the wall of the housing of the respective connector in order to simplify location of the shielding plate in the connector.

The shielding plate 14 accommodated in the socket connector 1 is identical to the shielding plate 15 of the plug connector 2. The shielding plates 14 and 15 are placed in the longitudinal direction in the socket connector 1 or plug connector 2, respectively, in such a way that a closed contact element 18 always appears opposite an open contact element 19. Variants of this are possible as will be explained below by reference to FIGS. 14 to 17 inclusive.

Figure 4:
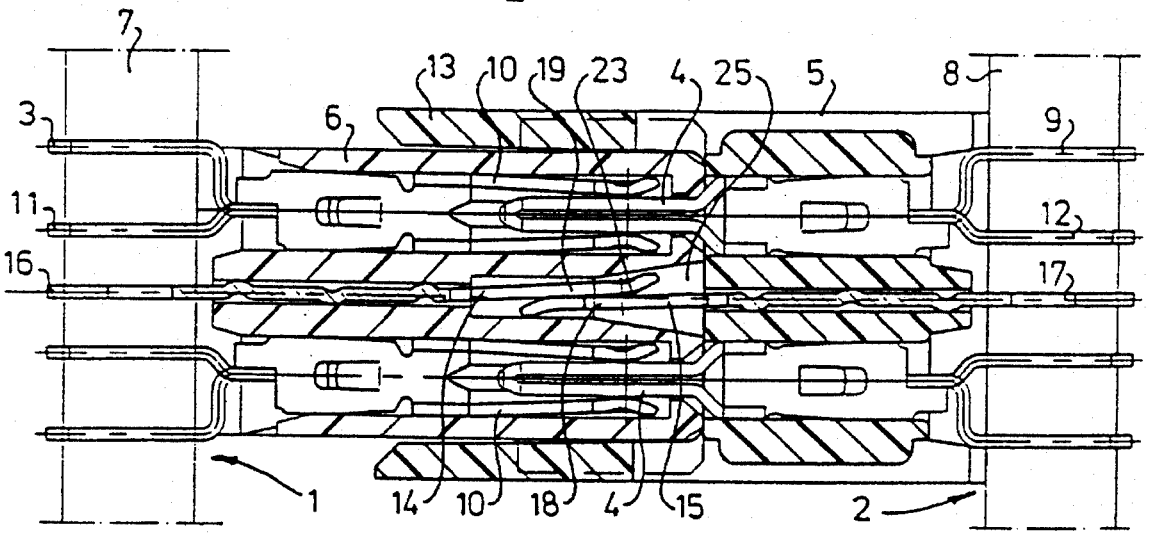
FIG. 4 shows an enlarged view of FIG. 2*c;*

Essential to the invention is that both the closed contact element 18 and the open contact element 19 are constructed so as to spring with respect to the support 22. As a result, it is possible to make an electromagnetic screen between two rows of electrical connections, which screen has a maximum thickness of approximately twice the thickness of the plate material used for the screen 14, 15 when socket connector and plug connector are pushed into one another. The last-mentioned thickness of the plate material used is preferably 0.15 mm. All this will become clearer by reference to FIG. 4 which is an enlarged version of FIG. 2*c*. It can clearly be seen that, when socket connector and plug connector are pushed into one another, the shielding plate 14 of the socket connector 1 is in contact with the shielding plate 15 of the plug connector 2. The situation shown is that in which an open contact element 19 of the shielding plate 14 is in contact with a closed contact element 18 of the shielding plate 15. The small dimple 23 (24) ensures, under these circumstances, the desired mechanical contact stress between the two shielding plates 14 and 15. In order to facilitate pushing over one another, both the end of the closed contact element 18 and the end of the open contact element 19 are to some extent bent. Both the open contact element 19 and the closed contact 18 are bent aside to some extent as a consequence of the spring action. In the situation of FIG. 4, the open contact element 19 can give way somewhat further because the end thereof is situated in a funnel-shaped opening 25 provided in the plastic housing 6. Next to the open contact element 19 is a closed contact element 18 (not shown) in the socket connector 1, which closed contact element 18 can bend aside somewhat further in its own funnel-shaped opening 25 than the open contact element 19, mating therewith, of the plug connector 2. The total thickness which the plate-type shielding requires at the position of the contact between an open and a closed contact element is twice the thickness of the plate material used for the contact elements (preferably, 0.15 mm thick) plus twice the space which is needed for a bent end of each of the shielding plates 14, 15.

Figure 5:
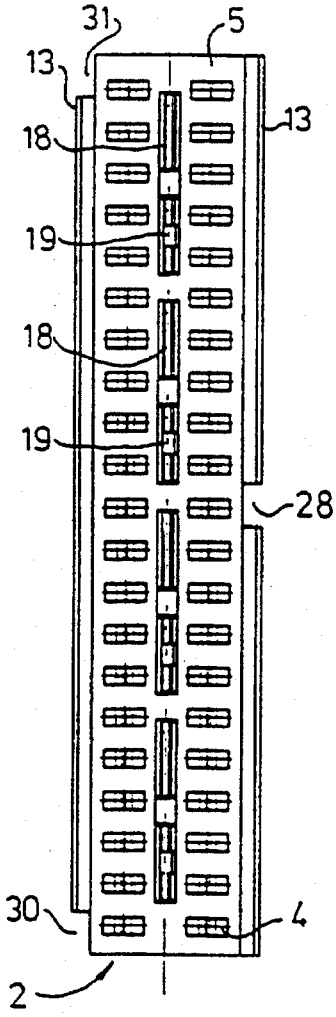
FIG. 5 shows a view of a plug connector having male terminal pins and shielding plates.

FIGS. 5 to 8 inclusive show an individual male plug connector 2 according to the invention in various views. FIG. 5 shows a plan view of a plug connector 2. The connector 2 contains two rows of 21 male terminal pins 4. This number is only an example. Between the two rows there is a shielding plate of alternately closed and open contact elements 18, 19. All the contact elements 18, 19 are able to make electrical contact with one another via a support 22 (FIG. 3). It is also possible, however, that the support 22 is cut through between two adjacent contact elements and the shielding consists of electrically separated sections each having their own voltage. FIG. 5 shows four pairs of open and closed contact elements 18, 19. Another number is, however, possible within the scope of the invention. At one side of the plastic housing 5, the wall 13 has an opening 28 for mating with a projection 29 of the socket connector 1, while the other lip 13 has at its ends openings 30, 31 for mating with projections 32, 33 of the socket connector 1 (see FIG. 9).

Figure 6:
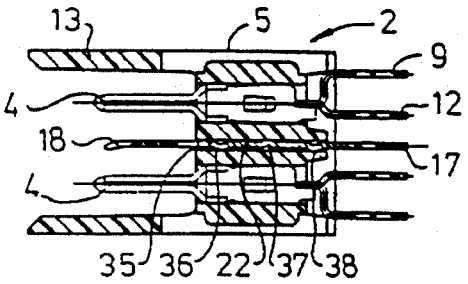
FIG. 6 shows a cross section of the connector according to FIG. 5.

FIG. 6 shows a separate plug connector 2 in cross section, the reference numerals being the same as in FIG. 4. FIG. 6 also reveals another characteristic of the present invention. The support 22 of the shielding plate is situated in an opening 35 of the housing 5. Because the support is provided with protuberances 36, 37 and 38, the shielding cannot, however, easily be moved to and fro through the opening 35 of the housing 5. On the other hand, by making use of the protuberances 36, 37, 38, the openings 35 can be wider than the thickness of the plate material used for the shielding. As a result, prior to mounting the shielding in the opening 35, the end of the contact element 18, 19 can be bent, after which the entire shielding 14, 15 is pushed through the opening 35. In practice, that is done from the bottom of the connector, that is to say in the plane of the drawing seen from right to left. After the description of FIG. 4, FIG. 6 requires no further explanation.

Figure 7:
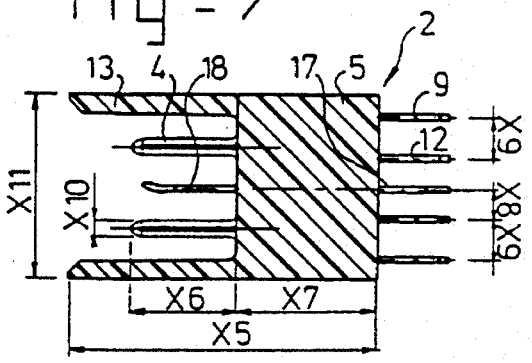
FIG. 7 shows a side view of the connector according to FIG. 5.

FIG. 7 shows a side view of the plug connector 2 in which some preferred dimensions are included. The height ×5 of the connector is preferably 7.4 mm, the height ×6 to which the terminal pins project 2.5 mm, the height ×7 of the base of the housing 5 3.4 mm, the spacing ×8 between the feed-through 17 of the shielding and the closest feed-through 12 of a terminal pin 4 in lateral projection 0.75 mm, the spacing ×9 between two adjacent feed-throughs 9 and 12 of terminal pins 4 in lateral projection 1.0 mm, the thickness ×10 of a terminal pin 0.4 mm, and the width ×11 of the housing 4.5 mm. Of course, other dimensions are possible within the scope of the invention.

Figure 8:
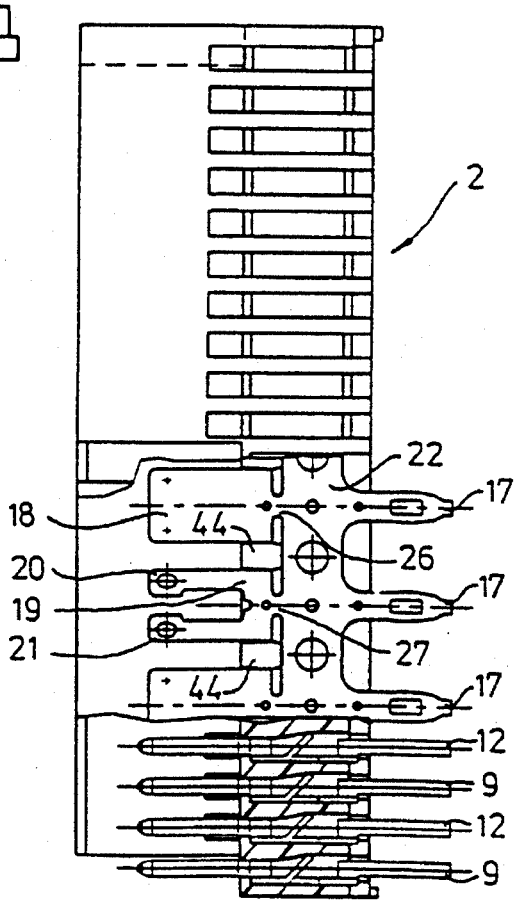
FIG. 8 shows a cutaway longitudinal view of the connector according to FIG. 5.

FIG. 8 shows a cutaway longitudinal view of a separate plug connector 2 according to the invention. After FIG. 4, this figure does not require a separate explanation.

Figure 9:
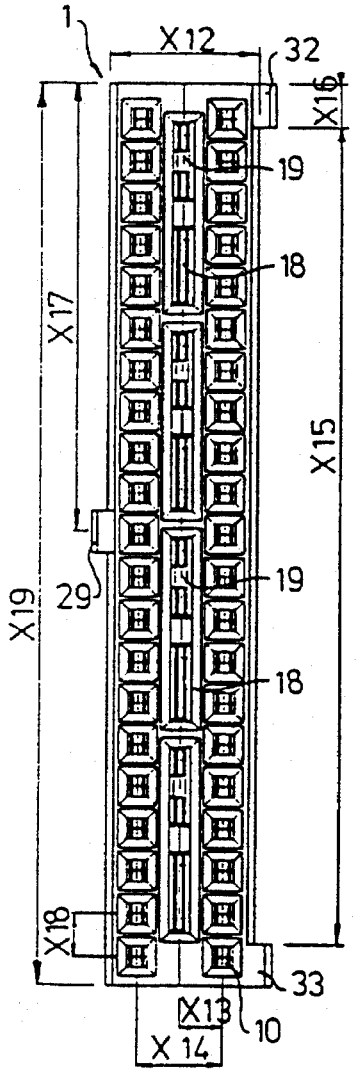
FIG. 9 shows a plan view of a socket connector having female terminal connections and shielding plates.

FIG. 9 shows a plan view of a socket connector according to the invention. Two rows, each of 21 female terminal connections 10, are shown, which rows are separated by a shielding plate provided with four pairs of alternating contact elements 18, 19. The numbers shown here have been arbitrarily chosen and can also be different within the scope of the invention. The projections 29, 32 and 33 are provided to mate with the openings 28, 30 and 31 of the plug connector (FIG. 5). Of course, the dimensions of the socket connector are furthermore such that each female terminal connection 10 is able to mate with a male terminal pin 4 of a plug connector. The closed and open contact elements 18, 19 are so positioned that, when a plug connector and a socket connector are brought into contact, an open contact element 19 always ends up opposite a closed contact element 18, after which they come into contact with one another in a sliding manner and both are also bent to some extent in a sprung manner, as explained above.

FIG. 9 shows some dimensions which, of course, also apply to the corresponding dimensions of the plug connector of FIG. 5. The width ×12 of the socket connector 1 is 3.5 mm, the spacing ×13 between the shielding plate and the centres of the female terminal connections 10 1.0 mm, the spacing ×14 between the centreline of the two rows of female terminal connections 10 2.0 mm, the total length ×19 of the socket connector 1 21.5 mm, the length ×16 of the projections 32 and 33 1.0 mm, the spacing ×17 between the centre of the projection 29 at the edge 10.75 mm, and the spacing ×18 between two adjacent female terminal connections 1.0 mm.

Figure 10:
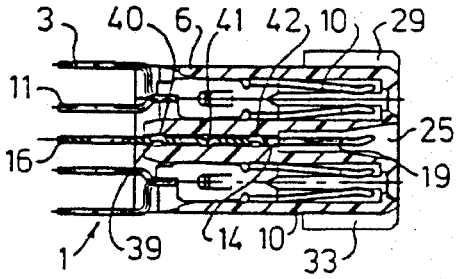
FIG. 10 shows a cross section of the connector according to FIG. 9.

FIG. 10 shows a socket connector according to the invention in cross section. The funnel-shaped opening 25 can be clearly seen and is intended for the bending-aside of the contact element 19 (or 18) if the socket connector 1 is pushed into a plug connector 2 and the contact element 19 (or 18) comes into sliding contact with an oppositely situated contact element 18 (or 19) of the shielding plate 15 of the plug connector 2. The shielding plate 14 is led through an opening 39 of the housing 6 in the same way as the shielding plate 15 in FIG. 6 after the end of the contact element 19 (or 18) has been bent. The opening 39 is wider than the thickness of the plate material used for the shielding plate. Protuberances 40, 41 and 42 have the same function as the protuberances 36, 37 and 38 in FIG. 6. The completely finished shielding plate 14 is pushed from left to right through the opening 39 of the housing 6 in the plane of the drawing in FIG. 10. In other respects, FIG. 10 requires no further explanation after FIG. 4.

Figure 11:
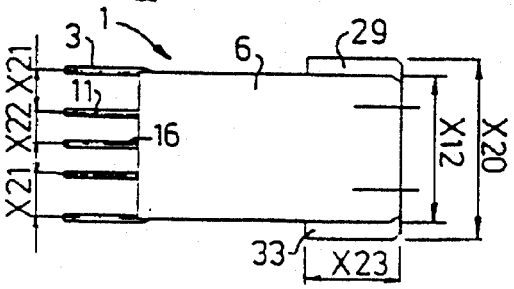
FIG. 11 shows a side view of the connector according to FIG. 9.

FIG. 11 shows a side view of a socket connector 1. The width ×12 of the socket connector (cf. FIG. 9) is 3.5 mm, while the width, inclusive of the projections 29 and 32/33 (×20) is 4.3 mm. The spacings ×21 and ×22 correspond to the spacings ×9 and ×8, respectively, of FIG. 7. The height ×23 of the projection 29, 32 and 33 is 2.25 mm. Of course, these dimensions are again also examples of an embodiment of the invention and they are not intended to limit it.

Figure 12:
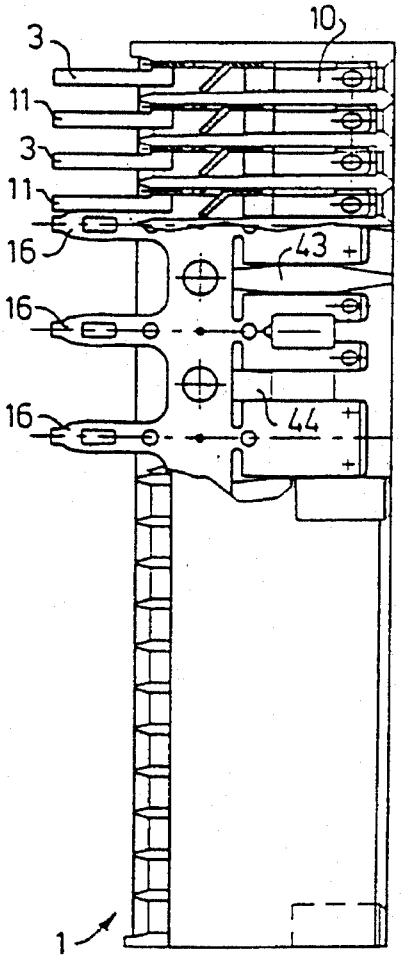
FIG. 12 shows a cutaway longitudinal view of the connector according to FIG. 9.

FIG. 12 shows a separate, cutaway socket connector 1 in the longitudinal direction. The reference numerals are identical to those which have also been used in FIG. 4, so that FIG. 12 requires no separate explanation.

Figure 13:
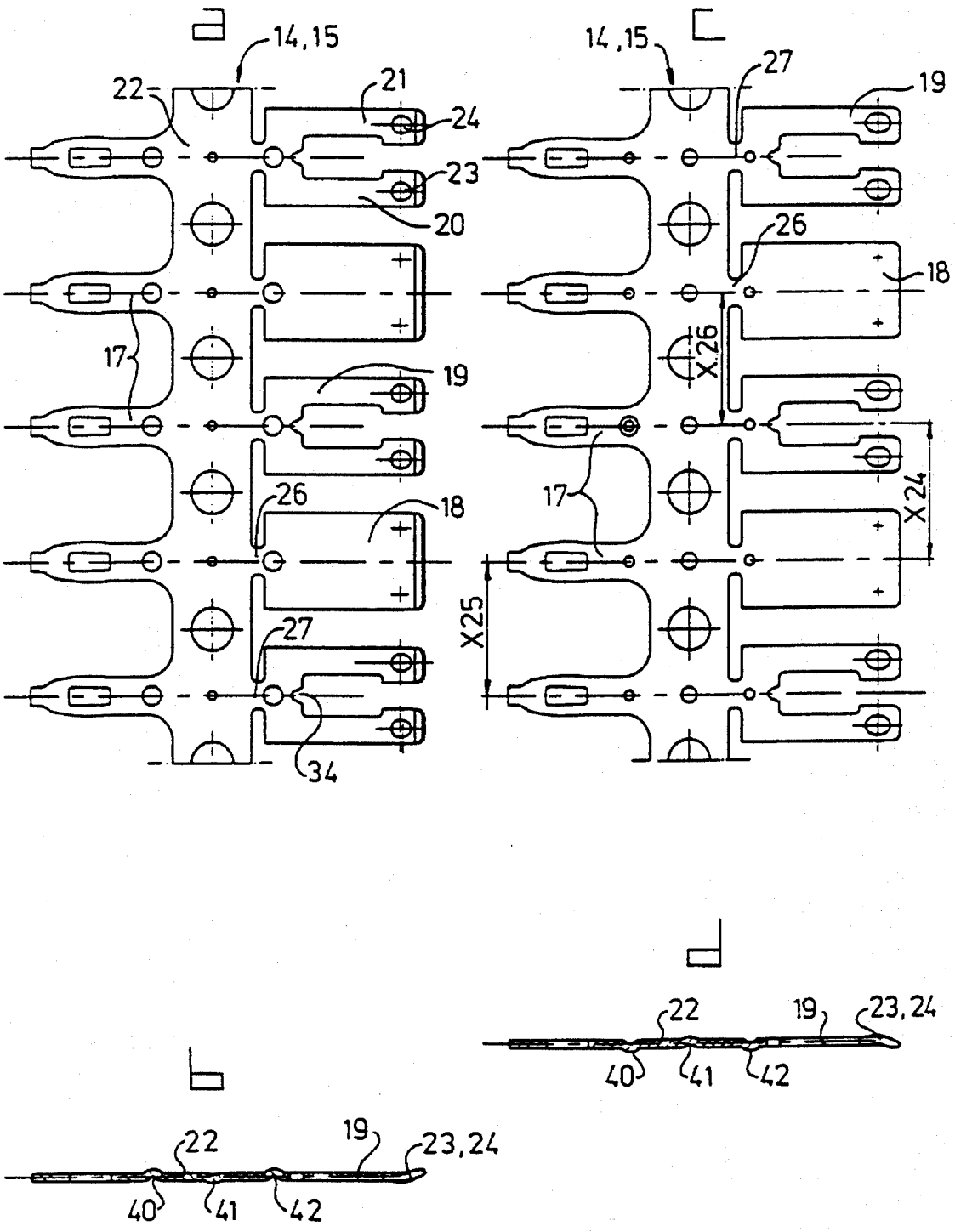
FIGS. 13*a* to *d* inclusive show a shielding plate such as is used in the present invention.
Figure 14:
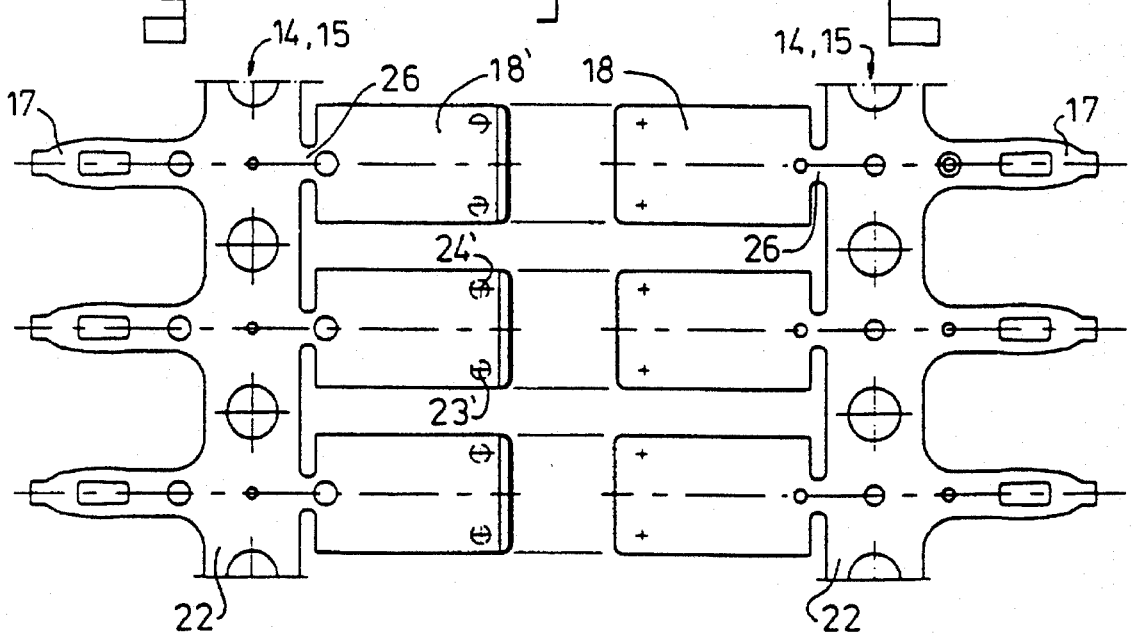
FIG. 14 shows first alternative shielding plates according to the invention.
Figure 15:
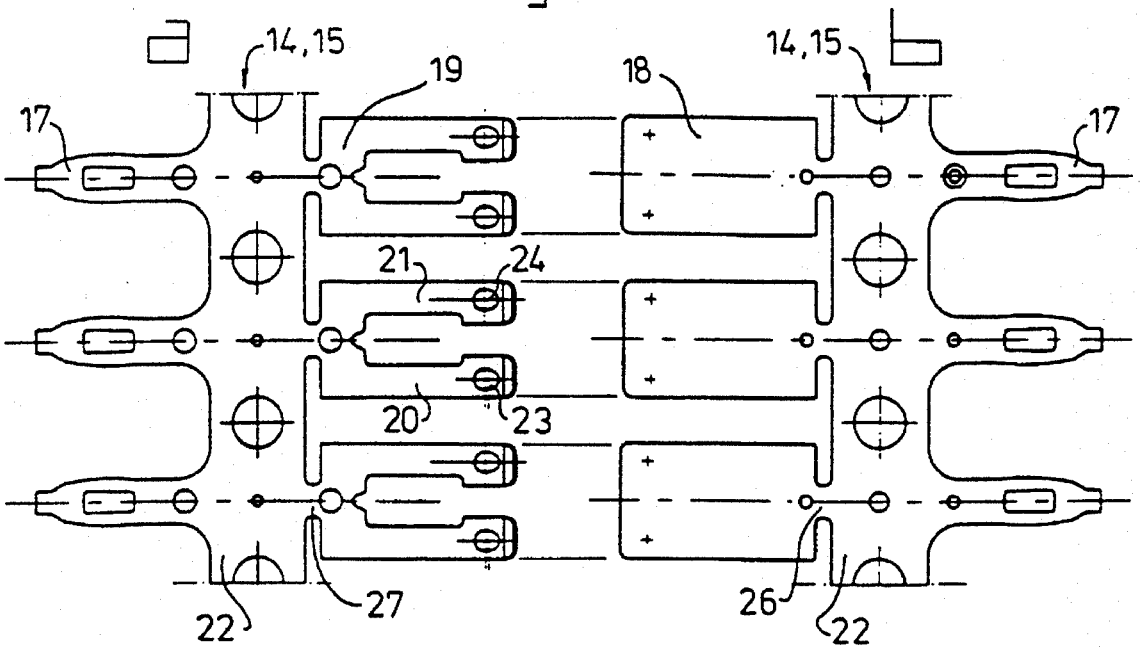
FIG. 15 shows second alternative shielding plates according to the invention.
Figure 16:
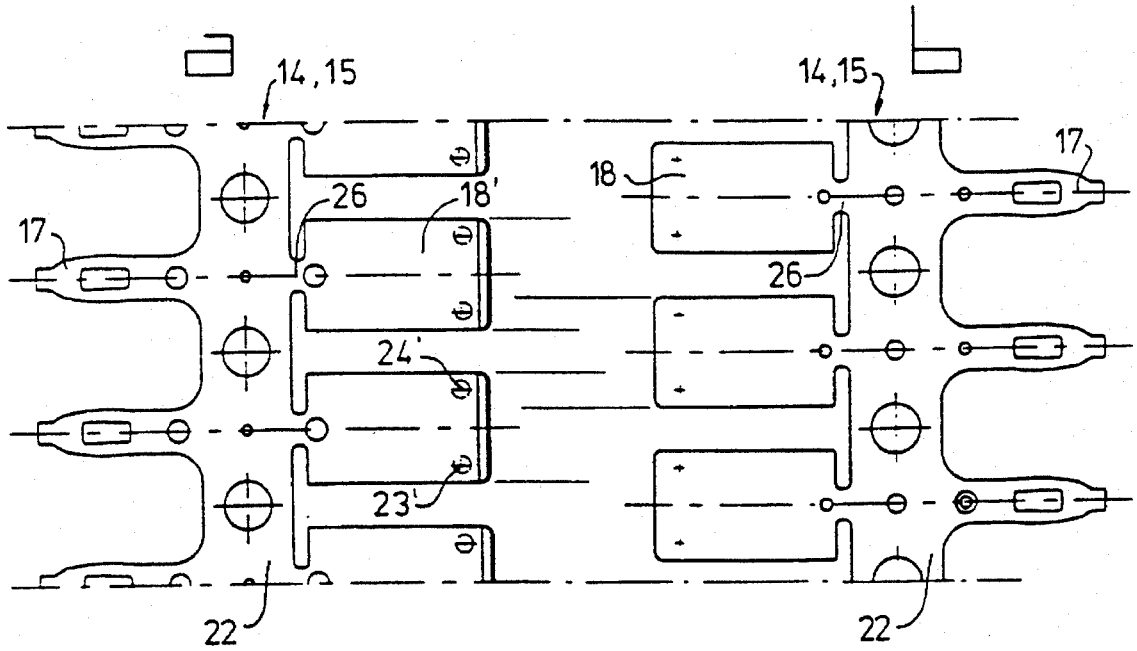
FIG. 16 shows third alternative shielding plates according to the invention.

FIG. 13*a* to *d* inclusive show separate strip-type shieldings 14, 15 according to the invention. In a preferred embodiment of the invention, the shielding plates 14 and 15 are identical and can be made with one die. As stated above, each shielding plate consists of a support 22 which has on its one side feed-throughs 17 for feeding through a printed circuit board. Provided at its other side are alternately closed contact elements 18 and open contact elements 19 which are bent to some extent at their end (FIG. 13*b* and *d*). The ends of the open contact elements consist of two lips 20, 21 which are each provided with a small dimple 23, 24. In the housing, which is not shown in FIG. 13, a rib can be provided which mates with a small notch 34 in the opening of the open contact element 19 so that the open contact element 19 is satisfactorily held in the correct position.

FIG. 13*c* shows some dimensions for explaining the shielding plate according to the invention. The centre-to-centre spacing ×24 between two adjacent contact elements 18 and 19 is 2.5 mm. The spacing ×25 between two adjacent feed-throughs 17 may also be 2.5 mm, but may be chosen independently of the spacing ×24. The spacing ×24 can also be freely chosen with respect to the spacing between adjacent terminal pins 4 or adjacent terminal connections 10. The centre-to-centre spacing ×26 between the necks 26, 27 of two adjacent contact elements 18, 19 is, for example, also 2.5 mm but this does not necessarily have to be equal to the centre-to-centre spacing ×24 between two adjacent contact elements 18 and 19.

FIG. 13*b* and d once again show clearly the protuberances 40, 41 and 42 in the support 22 of a shielding plate which mate with an opening 39 (or 35) of the connector in which the shielding plate is positioned.

FIGS. 14*a* and b show a first variant of the shielding plates 14, 15 as shown in FIGS. 13*a* and *b*. The shielding plate 4, 15 of both FIG. 14*a* and of FIG. 14*b* comprises only closed contact elements. The contact elements 18 of FIG. 14*b* are identical to those of FIG. 13, while the contact elements 18' of FIG. 14*a* are provided with small dimples 23', 24' which have the same function as the small dimples 23, 24 which are provided on the lips 20, 21 of an open contact element 19. The shielding plates 14, 15 of FIGS. 14*a* and *b* can be made with the same die. After that, the contact elements 18' of half the still identical shielding plates 14, 15 made in this way have to be provided with small dimple 23', 24' Characteristic of the embodiment of FIGS. 14*a* and *b* is, furthermore, that one shielding plate 14, 15 having contact elements 18, for example provided in a plug connector 2, is positioned opposite a shielding plate 14, 15, mating therewith, provided with contact elements 18', provided in a socket connector 1 in such a way that the contact elements 18 and 18' end up precisely opposite one another. Of course, it is also possible that all the plug connectors 2 are provided with shielding plates 14, 15 having contact elements 18' and all the socket connectors 1 with shielding plates 14, 15 having contact elements 18.

It is also possible to make one type of shielding plates 14, 15 which has only open contact elements 19 and one type of shielding plates 14, 15 which has only closed contact elements 18, as is explained in FIGS. 15*a* and *b*. The small dimples 23, 24 are then provided in the lips 20, 21 of the open contact elements, although it is possible to provide them instead thereof on the closed contact elements 18. In the embodiment of FIGS. 15*a* and *b*, the shielding plates 14, 15 are again positioned in a plug connector and a socket connector in such a way that an open contact element 19 always appears precisely opposite a closed contact element 18 when one connects a plug connector to a socket connector.

In all the embodiments shown hitherto, there is always a narrow slit between adjacent contact elements 18/19, 18/18, 18'/18' and 19/19 which slit continues to exist if a plug connector and a socket connector are pushed onto one another. Electromagnetic interference can still leak through the slit. This shortcoming can be remedied with the embodiment of FIGS. 16*a* and *b*. The embodiment of FIGS. 16*a* and b makes use of the same two shielding plates 14, 15 as are shown in FIGS. 14*a* and b. The difference is, however, that the shielding plate 14, 15 having closed contact elements 18' is situated in its connector (plug connector or socket connector) offset in such a way with respect to the shielding plate 14, 15 having closed contact elements 18 in the connector mating therewith (socket connector or plug connector) that if the two connectors are connected to one another, the contact elements 18 and 18', respectively, completely close off the slit between oppositely situated contact elements 18' and 18, respectively.

Figure 17:
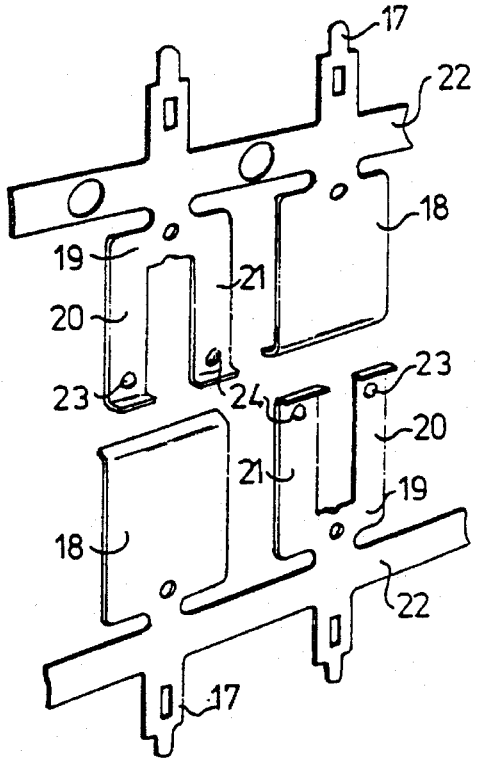
FIG. 17 shows fourth alternative shielding plates according to the invention.

The ends of the contact elements 18, 18' and 19 of all the shielding plates 14, 15 hitherto discussed are all bent in the same direction for each shielding plate. The consequence of this is that, if a plug connector and a socket connector have been pushed into one another, all the contact elements 18, 18' and/or 19 of a shielding plate are bent aside to the same side and the entire shielding plate is therefore under mechanical stress towards one side. If this is a drawback, it can be remedied by bending adjacent contact elements 18, 18', 19 turn and turn about to the other side and to position the shielding plates in two mating connectors in such a way that adjacent contact elements 18, 18', 19 of a shielding plate are always bent aside towards a different side when the connectors are pushed onto one another. In FIG. 17, this situation is shown for shielding plates provided with alternately open 19 and closed contact elements 18. Such a construction is, however, also possible for the shielding plates of FIGS. 14 and 15 (not for those of FIG. 16). The construction of FIG. 17 eliminates, at least virtually, a mechanical stress on the entire shielding plate.

To increase the electrical conductivity, all the faces of the contact elements 18, 18', 19 in a connector which come into contact with mating contact elements 18, 18', 19 in another connector can be provided with a thin gold layer. In the embodiments of FIG. 13 to 16, a thin gold layer on one side of the different contact elements is sufficient. In the embodiment of FIG. 17 and embodiments related thereto, such as those described above, such a thin gold layer has to be provided on two sides of the contact elements or turn and turn about on a different side in adjacent contact elements because the contact elements always make contact turn and turn about at their other side with another contact element.

The invention is not limited to the exemplary embodiments described above. Any limitations ensue only from the attached claims. In the figures, for example, there are two parallel rows of terminal pins 4, or parallel rows of terminal connections 10, but in principle, a larger number of parallel rows is possible, with shieldings between each of the rows.

I claim:

1. Electrical connector assembly, comprising a plug connector and a socket connector mating therewith, which plug connector and socket connector can be pushed into one another, which plug connector is provided with at least two rows of terminal connections comprising at least one of at least one row of male terminal pins and at least one row of female terminal connections which are accommodated in a first plastic housing, and which socket connector is provided with at least two rows of terminal connections comprising the other of said at least one row of male terminal pins and at least oen row of female terminal connections which are accommodated in a second plastic housing, and said socket connector comprising the other of said at least one row of male terminal pins and at least one row of female terminal connections, one male terminal pin always being in electrically conducting contact with a female terminal connection when the plug connector and socket connector are pushed into one another, the plug connector being provided with at least one electrically conducting first shielding member arranged between said rows of terminal connections in the plug connector and being rigidly accommodated in the first housing and comprising at least one resilient contact element, the socket connector being provided with at least one conducting second shielding member arranged between said rows of terminal connections in the socket connector and being rigidly accommodated in the second housing and comprising at least one resilient contact element, which first shielding member and second shielding member make electrically conducting contact with one another when the plug connector and the socket connector have been pushed into one another, each said contact element of each said first shielding member within the plug connector being a resilient, flat contact element and each said contact element of the second shielding member within the socket connector being a resilient, flat contact element, whereby when the socket connector and the plug connector are connected to each other each contact element of the first shielding member is slid along at least one contact element of the second shielding member such that said each other contact element of said first shielding member and said at least one contact element of said second shielding member deflect from each other in opposite directions and are maintained in electrical contact by spring action of said contact elements of said first and second shielding members in a non-gripping manner.

2. Electrical connector assembly according to claim 1, wherein the first shielding member is provided with an elongated support to support each resilient contact element and wherein each contact element is connected to the support via a narrow neck substantially narrower than said contact element so as to provide the resilient action.

3. Electrical connector assembly according to claim 1, wherein the second shielding member is provided with an elongated support to support each resilient contact element and wherein each contact element is connected to the support via a narrow neck substantially narrower than each said contact element so as to provide the resilient action.

4. Electrical connector assembly according to claim 2, wherein the first shielding member comprises several contact elements which are arranged alongside one another and consist of alternately closed contact elements and open contact elements, the open contact elements comprising at least two lips connected in a U-shaped configuration to said elongated support via said narrow neck.

5. Electrical connector assembly according to claim 3, wherein the second shielding member comprises several contact elements which are arranged alongside one another and consist of alternately closed contact elements and open contact elements, the open contact elements comprising at least two lips connected in a U-shaped configuration to said elongated support via said narrow neck.

6. Electrical connector assembly according to claim 4, wherein a small dimple is provided on the ends of the lips.

7. Electrical connector assembly according to claim 1, wherein the first and second shielding members comprise several contact elements which are arranged alongside one another and consist of alternately closed contact elements and open contact elements, the open contact elements comprising at least two lips connected in a U-shaped configuration, wherein when the plug connector and the socket connector are connected to one another, closed contact elements are always situated opposite open contact elements.

8. Electrical connector assembly according to claim 1, wherein the first shielding member comprises several closed contact elements situated alongside one another.

9. Electrical connector assembly according to claim 1, wherein the second shielding member comprises several closed contact elements situated alongside one another.

10. Electrical connector assembly according to claim 8, wherein the closed contact elements of the first shielding member are provided with small dimples at their end.

11. Electrical connector assembly according to claim 9, wherein the closed contact elements of the second shielding member are provided with small dimples at their end.

12. Electrical connector assembly according to claim 1, wherein the first shielding member comprises several closed contact elements situated alongside one another and the second shielding member comprises several open contact elements situated alongside one another, the open contact elements comprising at least two lips connected in a U-shaped configuration, whereby when the plug connector and the socket connector are connected to one another, each closed contact element is situated opposite an open contact element.

13. Electrical connector assembly according to claim 1, wherein the second shielding member comprises several closed contact elements situated alongside one another and the first shielding member comprises several open contact elements situated alongside one another, the open contact elements comprising at least two lips connected in a U-shaped configuration, whereby when the plug connector and the socket connector are connected to one another, each closed contact element is situated opposite an open contact element.

14. Electrical connector assembly according to claim 1, wherein the second shielding member comprises several closed contact elements situated alongside one another and the first shielding member comprises several closed contact elements situated alongside one another, whereby when the plug connector and the socket connector are connected to one another, the closed contact elements of the second shielding member close off the opening between adjacent, oppositely situated closed contact elements of the first shielding member and the closed contact elements of the first shielding member close off the opening between adjacent, oppositely situated closed contact elements of the second shielding member.

15. Electrical connector assembly according to claim 1, wherein the ends of the contact elements of the second shielding member are bent, and wherein the ends of the contact elements of the first shielding contact member are bent.

16. Electrical connector assembly according to claim 1, wherein the first shielding member is made of conducting plate material approximately 0.15 mm thick.

17. Electrical connector assembly according to claim 1, wherein the second shielding member is made of conducting plate material approximately 0.15 mm thick.

18. Electrical connector assembly according to claim 4, wherein the open contact element is provided with a notch in a section which connects the two lips to one another, which notch mates with a rib provided on the wall of the respective housing.

* * * * *

UNITED STATES PATENT AND TRADEMARK OFFICE

CERTIFICATE OF CORRECTION

PATENT NO. : 5,611,700

DATED : March 18, 1997

INVENTOR(S) : Niranjan K. Mitra

It is certified that error appears in the above-indentified patent and that said Letters Patent is hereby corrected as shown below:

Column 1, Line 61 - The word "miniaturized" should actually be the word "miniaturization".

Column 7, Line 19 - A comma "," should appear between the words "say" and "in".

Column 8, Line 65 - The number "4" should actually be the number "14".

Column 9, Line 8 - A period "." should be placed between "24"' and "Characteristic".

Column 10, Line 34 - In Claim 1, the word "oen" should actually be the word "one".

Signed and Sealed this

Eighth Day of July, 1997

Bruce Lehman

*Attest:*

BRUCE LEHMAN

*Attesting Officer*

*Commissioner of Patents and Trademarks*